US005617075A

United States Patent [19]

Worth et al.

[11] Patent Number: 5,617,075

[45] Date of Patent: Apr. 1, 1997

[54] PERSONAL ALARM SECURITY DEVICE

[76] Inventors: Sharon I. Worth; Tracy J. Worth, both of 17600 43rd Ave. N., Plymouth, Minn. 55446

[21] Appl. No.: 430,826

[22] Filed: Apr. 28, 1995

[51] Int. Cl.[6] ..... G08B 13/00

[52] U.S. Cl. ..... 340/574; 250/221; 340/693

[58] Field of Search ..... 340/574, 556, 340/693, 600, 546, 522; 250/221

[56] References Cited

U.S. PATENT DOCUMENTS

| | | | |
|---|---|---|---|
| 4,255,745 | 3/1981 | Rohan et al. | 340/546 |
| 4,262,285 | 4/1981 | Poley | 340/574 |
| 4,404,549 | 9/1983 | Berg | 340/574 |
| 4,520,351 | 5/1985 | Altman et al. | 340/574 |
| 4,587,516 | 5/1986 | Hiraki | 340/574 X |
| 4,617,556 | 10/1986 | Rivera et al. | 340/546 |
| 4,633,232 | 12/1986 | Nelson et al. | 340/542 |
| 4,667,188 | 5/1987 | Schwartz | 340/689 |
| 4,731,604 | 3/1988 | Pawlowski, Jr. | 340/574 |
| 4,797,661 | 1/1989 | Wiley | 340/664 |
| 4,829,285 | 5/1989 | Brand et al. | 340/573 |
| 4,885,570 | 12/1989 | Chien | 340/571 |
| 4,938,476 | 7/1990 | Brunelle et al. | 272/93 |
| 4,978,946 | 12/1990 | Nordholm et al. | 340/573 |
| 4,998,093 | 3/1991 | Benoit | 340/556 |
| 5,005,002 | 4/1991 | Halperin | 340/574 |
| 5,006,832 | 4/1991 | Beaudry | 340/574 |
| 5,025,247 | 6/1991 | Bankes | 340/574 |
| 5,032,824 | 7/1991 | Corbin | 340/574 |
| 5,235,322 | 8/1993 | Obysovsky et al. | 340/574 |
| 5,241,300 | 9/1993 | Buschmann | 340/573 |
| 5,266,927 | 11/1993 | Sanders | 340/574 |
| 5,289,164 | 2/1994 | Novak | 340/574 |
| 5,325,085 | 6/1994 | Decker | 340/574 |
| 5,345,221 | 9/1994 | Pons et al. | 340/574 X |
| 5,471,199 | 11/1995 | Yuan | 340/574 |

*Primary Examiner*—Thomas J. Mullen
*Attorney, Agent, or Firm*—Moore & Hansen

[57] ABSTRACT

The personal alarm security device of the present invention is a hand-held apparatus that emits a loud sound when activated. The device is shaped to be held easily in the hand, and the preferred embodiment includes an indent where the forefinger may be positioned. Using a photoelectric switch, a beam of light is projected across the indent once the device is armed for use. The device is easily armed be removing an arming pin from a receptacle in the housing. Positioning the forefinger in the indent while the device is being armed breaks the circuit, and prevents the alarm from sounding. However, once armed, when the forefinger is removed, a loud siren is activated that can only be deactivated by replacing the arming pin, allowing the battery to wear out or destroying the device.

15 Claims, 2 Drawing Sheets

PERSONAL ALARM SECURITY DEVICE

BACKGROUND OF THE INVENTION

1. Technical Field

The present invention relates generally to alarms for warning of attack or intrusion, and particularly to hand-held, portable alarms that may be easily activated in the event of an attack or other hazardous occurrence.

2. Background Information

With the growth of population and the increasing size of cities around the world, individuals face an increasing risk of being subjected to violent crimes of a personal nature. These crimes can range from robberies and muggings to sometimes brutal physical attacks. Both men and women run the risk of being a victim of violent crime. Frequently the attacker is armed, leaving the victim helpless to retaliate. Responses to these dangers vary, although people are routinely advised to avoid areas where the risk of crime is greatest, and especially to avoid such areas after dark. Nevertheless, people sometimes find themselves leaving the workplace late at night, or trying to get some outdoor exercise in a secluded area, and, despite every precaution, they may still end up the victim of a violent crime.

One response to this threat is to carry a weapon. This solution, however, is not always workable, for a variety of reasons. Many argue that confronting an armed criminal with your own weapon may make a confrontation even more dangerous. Indeed, many experts advise against using weapons, such as guns, MACE, knives, etc. for self defense in a close struggle, since they may be turned against the victim and put the victim in greater danger.

Although resistance to a criminal is generally not recommended, it is often advised that drawing attention to the situation, as by screaming or yelling, may scare off a potential attacker. Similarly, distracting the attacker, even for only an instant, may provide the victim an opportunity to avoid harm. Many people, however, when faced with an attack, are too frightened to move or make a sound. Screaming or yelling may also provoke a violent response from the attacker.

To address this situation, a number of personal alarms have been developed in recent years. These personal alarms are battery operated devices that generate a very loud sound intended to draw attention to the immediate vicinity of the attack, and frighten the attacker into abandoning his plans and running away. Although such devices can be effective, there are several potential drawbacks to the use of most of the devices currently available. Chief among them is that two hands are generally required to activate these personal alarms. For example, one popular design requires that the user pull a pin from the alarm housing to activate the alarm. This requires using one hand to grasp the pin while the other holds the housing. An assailant attacking from the rear, however, may grab one or both arms of the intended victim, making it difficult or impossible to activate the alarm. A struggle by the victim in an attempt to activate the alarm may only result in greater injury to the victim.

In addition, many alarms have mechanical elements, including levers, springs and switches, that are subject to corrosion or the buildup of dirt, which may result in a malfunction at the single time when they are needed to work as expected. When the victim using the device is actually attacked, the device may fail because a mechanical element has been damaged through inadvertence or neglect.

The personal alarm security device of the present invention overcomes difficulties described above and affords other features and advantages heretofore not available.

SUMMARY OF THE INVENTION

The personal alarm security device of the present invention is a hand-held apparatus that emits a loud sound when activated. The device is shaped to be held easily in the hand, and the preferred embodiment includes an indent where the forefinger may be positioned. Using a photoelectric switch, a beam of light is projected across the indent once the device is armed for use. The device is easily armed by removing an arming pin from a receptacle in the housing. Positioning the forefinger in the indent while the device is being armed breaks the circuit, and prevents the alarm from sounding. However, once armed, when the forefinger is removed, a loud siren is activated that can only be deactivated by replacing the arming pin, allowing the battery to wear out or destroying the device.

Once armed, then, no affirmative action by the user is required to activate the siren of the personal alarm. In actual use, the user carrying the device will need only remove their finger from the indent to activate the siren. This will most likely happen involuntarily, either in an ensuing struggle as the victim resists or otherwise reacts to an attack or upon opening the hand upon being startled by an attacker. Even if the victim's response upon being attacked is to clench their fist, the only voluntary action required to activate the alarm is to release the device and let it fall to the ground. The shrill sound of the siren is audible for hundreds of yards in all directions, and the attention drawn to the scene of the attack is likely to frighten the attacker into abandoning the attack. Indeed, even in the instance where the victim is rendered unconscious in the initial attack, the alarm of the present invention will sound when it falls from the hand of the victim.

It is therefore an object of the present invention to startle attackers of victims using the device, causing the attackers to abandon their attack. It is a further object of the invention to provide such a device that startles the attackers using a very loud noise that draws attention of passers by to the scene of the attack. It is a further object of the invention to provide such a device that is very easy for the victim or potential victim of such an attack to carry and activate in the event of an attack.

It is a further object of the invention to provide a personal alarm that is not easily deactivated, so that an attacker cannot simply turn off the alarm to avoid drawing attention to the scene of the attack once the alarm has been activated. It is a further object of the invention to provide such a personal alarm that is easily manufactured of readily available materials and technology, is easily operable and may be made available at affordable prices. It is yet a further object of the invention to provide a personal alarm that is sturdy and includes solid state components that are not subjected to damage from neglect or inadvertent physical abuse.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
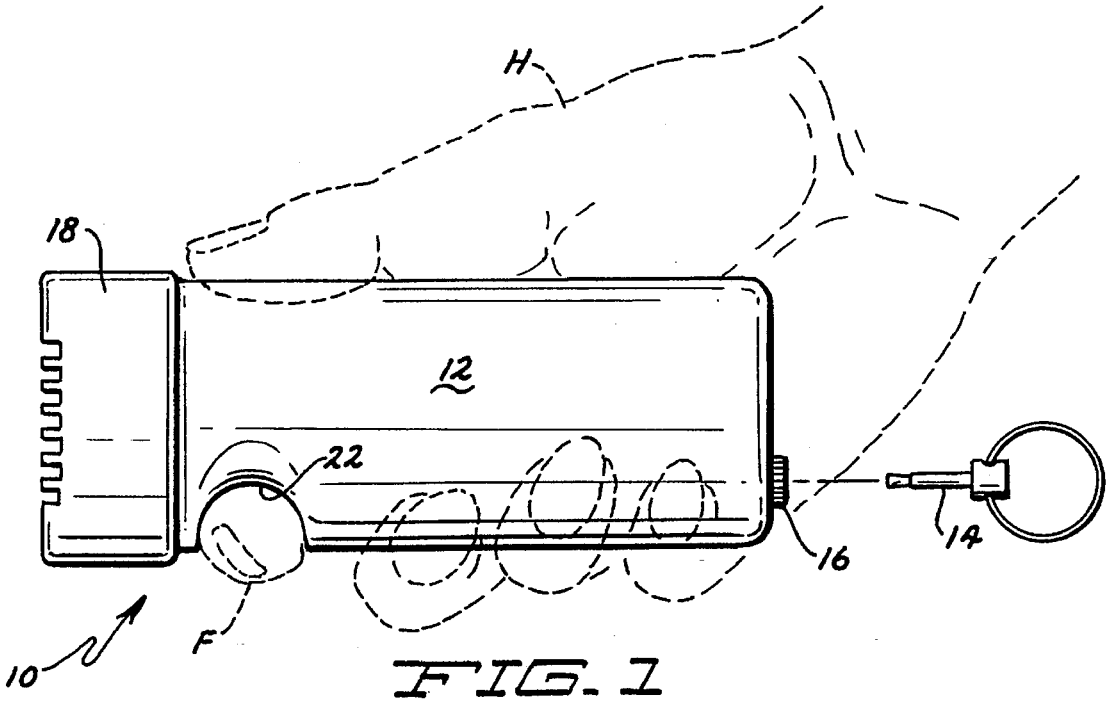
FIG. 1 is a side elevation view of the personal alarm of the present invention, showing the device being gripped in a user's hand.
Figure 2:
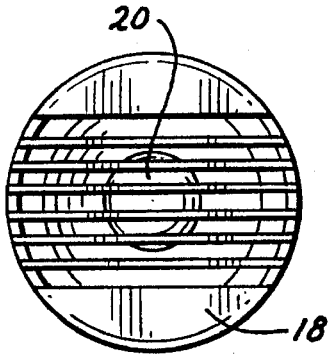
FIG. 2 is an end view of the invention taken from the left end of FIG. 1.
Figure 3:
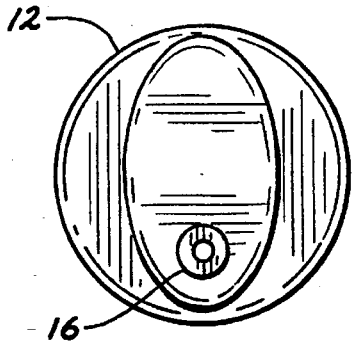
FIG. 3 is an end view of the invention taken from the right end of FIG. 1.

With reference to the drawings, and in particular to FIG. 1, the personal alarm security device is generally indicated by reference numeral 10. Security device 10 includes a housing 12 with an arming pin 14 and an arming pin receptacle or receiving member 16. Housing 12 also includes a speaker enclosure 18, within which is positioned a speaker 20, preferably capable of producing sounds in excess of one hundred decibels.

Figure 4:
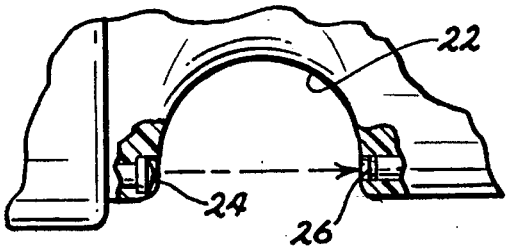
FIG. 4 is a partial sectional view of the finger indent of the invention.

Integral with housing 12 is an indent 22 for positioning a finger F of a hand H of the person using the personal security alarm 10. Referring to FIG. 4, indent 22 includes a sensor or transducer for detecting the presence or absence of the hand of the user of the personal alarm. In the preferred embodiment, the sensor includes a photoelectric switch having a light emitter 24 and a light receiver or collector 26. Light emitter 24 is preferably a photoemitter (an infrared emitting LED) and light collector 26 is preferably a phototransistor. Light emitter 24 and light collector 26 combine to form a solid state photoelectric switch which, when closed, activates the alarm.

Figure 5:
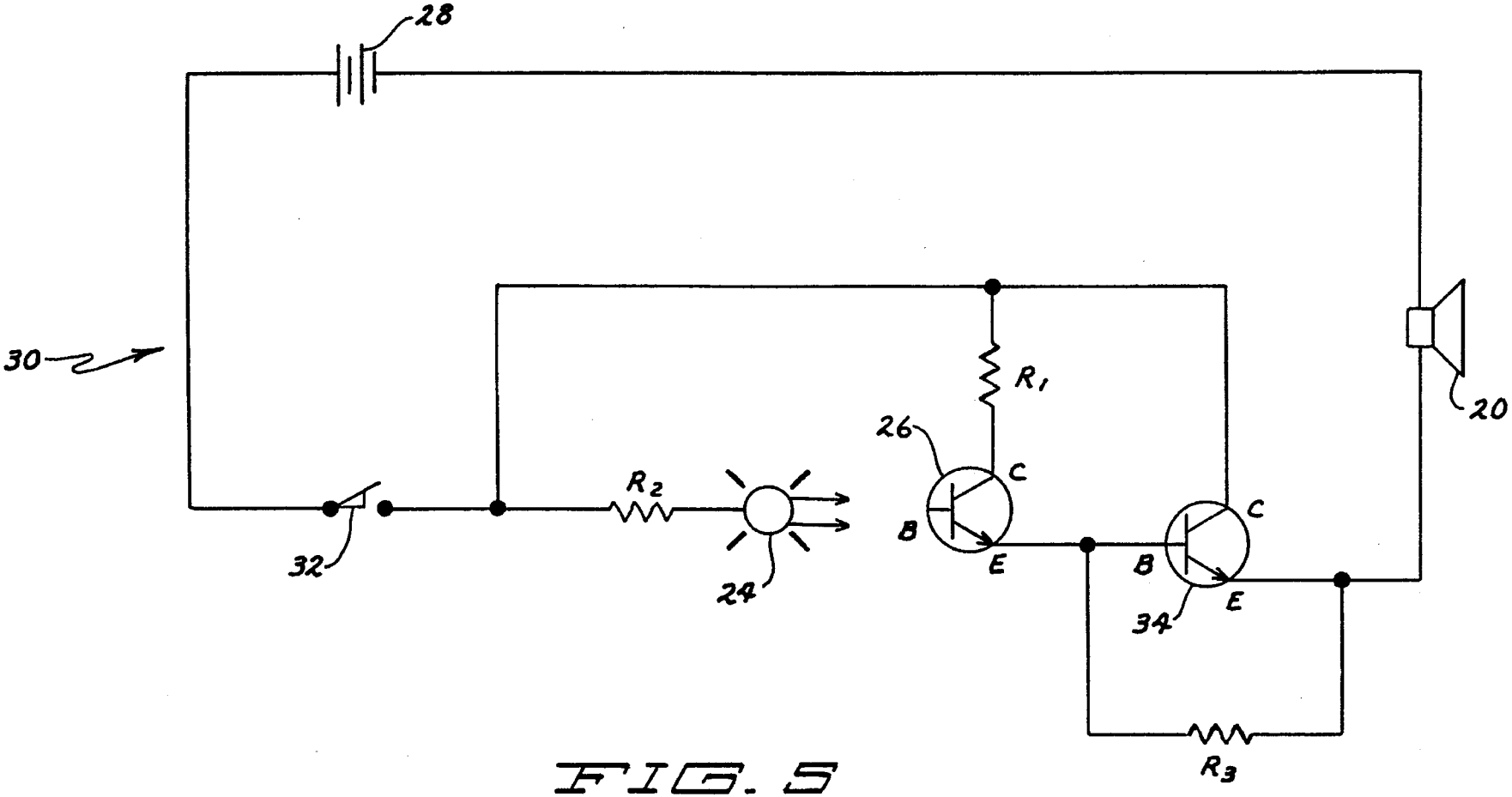
FIG. 5 is an electrical schematic of the invention.

FIG. 5 discloses a circuit 30, wherein the personal security alarm 10 receives power from a power source, consisting preferably of at least one battery 28. In the preferred embodiment, battery 28 is contained in a battery compartment having a cover (not shown) that preferably includes a pivoting tab that is difficult to operate without the help of a tool such as a flat blade screwdriver. Arming pin 14 activates arming pin switch 32, which is a normally closed held open switch that closes when arming pin 14 is removed from arming pin receptacle 16.

As seen in FIG. 5, circuit 30 includes resistors $R_1$, $R_2$ and $R_3$, photoemitter 24, phototransistor 26 and transistor 34. In normal use, when arming pin switch 32 is closed, the finger F of the user will normally be positioned between photoemitter 24 and phototransistor 26, keeping that circuit open. Circuit 30 thereby remains open, and no power is supplied to speaker 20. Upon removing finger F from indent 22 of housing 12, the photoelectric switch including photoemitter 24 and phototransistor 26 is closed, resulting in voltage being applied to base B of phototransistor 26. This causes current to flow from collector C to emitter E of phototransistor 26, resulting in voltage being applied to base B of transistor 34. This causes current to flow from collector C to emitter E of transistor 34, fully closing circuit 30, and actuating speaker 20. The presence of resistors $R_1$ and $R_2$ routes current flow around photoemitter 24 and phototransistor 26, and through transistor 34. Therefor, even if the circuit between photoemitter 24 and phototransistor 26 is again broken, as by replacing a finger F in indent 22 of housing 12, current will continue to flow through circuit 30 and speaker 20 will continue to sound. The only things that will now stop the siren will be running down or removing batteries 28, damaging or destroying circuit 30, or replacement of arming pin 14 in arming pin receptacle 16, reopening arming pin switch 32.

In normal use, a person about to go outdoors after dark or any other time when the function of a personal alarm is desired would grasp housing 12 of personal alarm security device 10 with a finger F of hand H positioned in indent 22, as illustrated in FIG. 1. Personal alarm security device 10 is then armed by removing arming pin 14 from arming pin receptacle 16 while keeping finger F in indent 22. Personal alarm security device 10 must be armed to function as intended. After removing arming pin 14, it should be placed in a secure location for repositioning in arming pin receptacle 16 after reaching the user's destination. Once armed, the photoelectric switch remains open until finger F is removed from indent 22. Once personal alarm security device 10 is armed, the user may now proceed to their destination. In the event of an attack or threat of an attack, the user need only remove finger F from indent 22 to actuate the alarm. This may be easily accomplished by simply dropping personal alarm security device 10. In many cases where the user is suddenly startled by an attacker, the natural response is automatically to drop whatever is being held in their hand, so activation of the alarm may not require any thought or effort.

The desired response is for the potential or actual attacker to give up the attack and run off as soon as the alarm sounds. In some instances, however, the attacker may try to find a switch on the alarm to turn off the siren. If the attacker is able to determine that the alarm was actuated by closing the circuit between light emitter 24 and light collector 26, the attacker will nevertheless be unable to stop the alarm by reopening that circuit, because circuit 30 has now bypassed the photoelectric switch between light emitter 24 and light collector 26. The only way to turn off the alarm is be reinserting arming pin 14 within arming pin receptacle 16. At this point, the alarm will preferably have drawn attention to the location of the attack, and the attacker will hopefully give up the effort and run away. Only after the attacker has completely left the scene should the user reinsert arming pin 14 within arming pin receptacle 16, thereby defeating the alarm and silencing speaker 20.

While the preferred embodiments of the invention have been described, it should be understood that various changes, adaptations and modifications may be made therein without departing from the spirit of the invention and the scope of the appended claims.

What is claimed is:

1. A personal alarm security device, comprising:

a housing;

first switch means mounted in said housing operable between open and closed positions;

electrical circuit means within said housing electrically connected to said first switch means;

a speaker mounted to said housing for producing a high decibel sound, said speaker being connected to said electrical circuit means;

a power source mounted within said housing and connected to said electrical circuit means;

photoelectric switch means mounted on said housing and operable between open and closed positions, said electrical circuit means including means for energizing said speaker upon closing both said first switch means and said photoelectric switch means, for maintaining power to said speaker until said first switch means is opened; and an indent in said housing cooperative with said photoelectric switch means, said indent having a first side and a second side, whereby the user of the personal alarm security device may position a finger in said indent, maintaining said photoelectric switch means in said open position.

2. The personal alarm security device described in claim 1, wherein said photoelectric switch means comprises:

a light emitter on said first side of said indent; and a light collector on said second side of said indent.

3. The personal alarm security device described in claim 2, wherein said light emitter comprises an infrared emitting light emitting diode.

4. The personal alarm security device described in claim 2, wherein said light collector comprises a phototransistor.

5. The personal alarm security device described in claim 2, wherein said first switch means comprises:

an arming pin switch cooperative with said electrical circuit means and operable between open and closed positions;

an arming pin receptacle fixedly attached to said housing and cooperative with said arming pin switch; and an arming pin removably receivable within said arming pin receptacle, whereby the user removes said arming pin from said arming pin receptacle while holding a finger in said indent, thereby closing said arming pin switch and arming the personal alarm security device, and the arming pin switch may only be reopened by reinserting said arming pin inside said arming pin receptacle.

6. A personal alarm security device, comprising:

a housing;

first switch means mounted in said housing operable between open and closed positions;

electrical circuit means within said housing electrically connected to said first switch means;

a speaker mounted to said housing for producing a high decibel sound, said speaker being connected to said electrical circuit means;

a power source mounted within said housing and connected to said electrical circuit means; and photoelectric switch means mounted on said housing and operable between open and closed positions, said photoelectric switch means including a light emitter mounted on said housing and a light collector mounted on said housing, said electrical circuit means including means for energizing said speaker upon closing both said first switch means and said photoelectric switch means, and for maintaining power to said speaker until said first switch means is opened.

7. The personal alarm security device described in claim 6, wherein said light emitter comprises an infrared emitting light emitting diode.

8. The personal alarm security device described in claim 6, wherein said light collector comprises a phototransistor.

9. A personal alarm security device comprising:

a housing;

electrical circuit means within said housing;

an arming pin switch cooperative with said electrical circuit means and operable between open and closed positions;

an arming pin receptacle fixedly attached to said housing and cooperative with said arming pin switch;

an arming pin removably receivable within said arming pin receptacle, whereby removing said arming pin from said arming pin receptacle closes said arming pin switch and arms the personal alarm security device, and the arming pin switch may be reopened only be reinserting said arming pin in said arming pin receptacle;

a speaker mounted to said housing for producing a high decibel sound, said speaker being connected to said electrical circuit means;

a power source mounted within said housing and connected to said electrical circuit means;

an indent in said housing, said indent having a first side and a second side;

a photoelectric switch mounted on said housing and cooperative with said electrical circuit means, said photoelectric switch being operable between open and closed positions and including a light emitter mounted on said first side of said indent and a light collector on said second side of said indent, whereby the user of the personal alarm security device may position a finger in said indent, maintaining said photoelectric switch in said open position; and said electrical circuit means includes means for energizing said speaker upon closing both said arming pin switch and said photoelectric switch, and for maintaining power to said speaker until said arming pin switch is opened.

10. The personal alarm security device described in claim 9, wherein said light emitter comprises an infrared emitting light emitting diode.

11. The personal alarm security device described in claim 9, wherein said light collector comprises a phototransistor.

12. The personal alarm security device described in claim 9, wherein said power source comprises a battery.

13. A personal alarm security device comprising:

a housing that may be held in the hand of the user of the device;

first switch means mounted in said housing operable between open and closed positions;

electrical circuit means within said housing electrically connected to said first switch means;

a speaker mounted to said housing for producing a high decibel sound, said speaker being connected to said electrical circuit means;

a power source mounted within said housing and connected to said electrical circuit means;

photoelectric switch means mounted on said housing and operable between open and closed positions, said photoelectric switch means being actuable upon release of said housing by the hand of the user; and said electrical circuit means includes means for energizing said speaker upon closing both said first switch means and said photoelectric switch means, and for maintaining power to said speaker until said first switch means is opened.

14. The personal alarm security device described in claim 13, wherein said power source comprises a battery.

15. The personal alarm security device described in claim 13, wherein said first switch means comprises:

an arming pin switch cooperative with said electrical circuit means and operable between open and closed positions;

an arming pin receptacle fixedly attached to said housing and cooperative with said arming pin switch; and an arming pin removably receivable within said arming pin receptacle, whereby removing said arming pin from said arming pin receptacle closes said arming pin switch and arms the personal alarm security device.

* * * * *